US012742289B2

(12) United States Patent
Campos Souza et al.

(10) Patent No.: US 12,742,289 B2
(45) Date of Patent: Sep. 22, 2026

(54) ADJUSTING ROLLS

(71) Applicant: VOITH PATENT GMBH, Heidenheim (DE)

(72) Inventors: José Luiz Campos Souza, Heidenheim (DE); Marc Erkelenz, Neu-Ulm (DE); Torben Beckmann, Neu-Ulm (DE)

(73) Assignee: VOITH PATENT GMBH, Heidenheim (DE)

( * ) Notice: Subject to any disclaimer, the term of this patent is extended or adjusted under 35 U.S.C. 154(b) by 115 days.

(21) Appl. No.: 18/277,492

(22) PCT Filed: Feb. 1, 2022

(86) PCT No.: PCT/EP2022/052288
§ 371 (c)(1),
(2) Date: Aug. 16, 2023

(87) PCT Pub. No.: WO2022/184356
PCT Pub. Date: Sep. 9, 2022

(65) Prior Publication Data

US 2024/0125049 A1 Apr. 18, 2024

(30) Foreign Application Priority Data

Mar. 1, 2021 (DE) ..... 10 2021 104 870.2

(51) Int. Cl.
*D21F 3/10* (2006.01)
*D21G 9/00* (2006.01)

(52) U.S. Cl.
CPC ..... *D21G 9/0036* (2013.01); *D21F 3/10* (2013.01)

(58) Field of Classification Search
CPC ..... D21F 3/10
(Continued)

(56) References Cited

U.S. PATENT DOCUMENTS 5,371,954 A 12/1994 Pinter et al.
2014/0070495 A1 3/2014 Schotge et al.
(Continued)

FOREIGN PATENT DOCUMENTS

AT 522782 2/2021
CN 103106682 5/2013
(Continued)

OTHER PUBLICATIONS

Translation of WO doc (Year: 2014).*
(Continued)

*Primary Examiner* — Jacob T Minskey
(74) *Attorney, Agent, or Firm* — GREENBLUM & BERNSTEIN, P.L.C.

(57) ABSTRACT

A method and an apparatus for adjusting a suction roll. The method includes: recording images and/or videos of the exterior of the roll and transmitting the recording to a computing unit; determining the actual values of the position of the sealing strips and/or edge deckles and/or other, non-visible components by the computing unit through image analysis of the image and/or video recording of the exterior of the roll and/or by acquiring values from an embedded sensor system; and displaying the determined actual values by superimposing the position of the non-visible components on a display with the image and/or video recording.

6 Claims, 1 Drawing Sheet

(58) Field of Classification Search
USPC ..... 162/198
See application file for complete search history.

(56) References Cited

U.S. PATENT DOCUMENTS

| | | | |
|---|---|---|---|
| 2017/0175331 | A1 | 6/2017 | Schotge et al. |
| 2021/0189653 | A1 | 6/2021 | Eckerstorfer et al. |

FOREIGN PATENT DOCUMENTS

| | | | | |
|---|---|---|---|---|
| CN | 103679204 | | 3/2014 | |
| CN | 207259864 | U | 4/2018 | |
| CN | 110799702 | | 2/2020 | |
| DE | 4241400 | | 6/1993 | |
| DE | 101 96 534 | | 7/2003 | |
| DE | 10 2004 014 519 | | 11/2004 | |
| DE | 10 2009 000 371 | | 8/2010 | |
| DE | 102011075806 | | 11/2012 | |
| DE | 10 2011 086 139 | | 5/2013 | |
| DE | 10 2015 207 383 | | 10/2016 | |
| EP | 2 707 544 | | 7/2015 | |
| WO | 02/20901 | | 3/2002 | |
| WO | WO-2014020049 | A1 * | 2/2014 | ..... D21F 3/105 |

OTHER PUBLICATIONS

German Office Action conducted in counterpart German Appln. No. 10 2021 104 870.2 (Aug. 5, 2025).
China Search Report & Office Action conducted in counterpart China Appln. No. 2022800169328 (May, 1, 2025).
Int'l Search Report (Form PCT/ISA/210) conducted in Int'l Appln. No. PCT/EP2022/052288 (May 10, 2022).
Int'l Written Opinion (Form PCT/ISA/237) conducted in Int'l Appln. No. PCT/EP2022/052288 (May 10, 2022).
German Search Report/Office Action conducted in counterpart German Appln. No. 10 2021 104 870.2 (Jan. 3, 2022).
Azuma, "A Survey of Augmented Reality," *Presence: Teleoperators and Virtual Environmnets* 6, 4 (Aug. 1997) pp. 355-385.
Wikipedia, https://de.wikipedia.org/wiki/Erweiterte_Realit%C3%A4t (translation—Augmented Reality).
Wikipedia, Reality-virtuality continuum, https://en.wikipedia.org/w/index.php?title=Reality%E2%80%93virtuality_continuum&oldid=1159918280.

* cited by examiner

ADJUSTING ROLLS

CROSS-REFERENCE TO RELATED APPLICATIONS

The present application is a U.S. National Stage of International Patent Application No. PCT/EP2022/052288 filed Feb. 1, 2022, and claims priority under 35 U.S.C. § 119(a) of German Patent Application No. 10 2021 104 870.2 filed Mar. 1, 2021. Moreover, the disclosure of International Patent Application No. PCT/EP2022/052288 is expressly incorporated by reference herein in its entirety.

BACKGROUND OF THE INVENTION

1. Field of the Invention

The invention relates to a method and an apparatus for adjusting suction rolls, in particular for use in a machine for producing or processing a paper web or a different web of fibrous material.

2. Discussion of Background Information

Suction rolls are perforated rolls with regions on the surface where a negative pressure is generated in order to retain water or to redirect the paper web. Said regions are referred to as "suction zones." The suction zones of a suction roll are separated by sealing strips that are located below the outer surface. Between the sealing strips and the outer roll surface, a water lubricating film forms, which seals the suction zones. Suction pressure rolls are a special type of suction roll. Together with a mating element, usually a mating roll, these suction rolls form a press nip for pressing and removing water from the web of fibrous material.

Suction rolls of this type, as well as the adjustable sealing strips and edge deckles, are described in documents DE 10 2009 000 371 or EP2707544 B1, for example.

The position of the sealing strips, and therefore the positioning of the region of the outer roll surface at which the negative pressure is present, is, in the case of suction pressure rolls for example, extremely important for enabling the optimal dewatering of the paper web. As a result of an incorrect positioning of the suction box, the dry content of the web of fibrous material can be 1-2 percentage points lower than in the case of an optimal positioning, which constitutes a massive loss of efficiency of the press.

These days, the adjustment of the suction box is performed manually while the machine is running, and is visually evaluated:

- The suction box is rotated on the operator side with the aid of markings (marker for the position of the sealing strips) until the position is approximately correct (no direct comparison between sealing strips and covering);
- nip dewatering spray is identified after the nip;
- kink of the covering is evaluated;
- difference in dry content on the press (if available). If the separation of the covering from the roll
  - takes place earlier-->nip dewatering spray is still visible, but false air in the roll and lower dry content can be expected;
  - takes place later-->no nip dewatering spray is visible and remoistening is more pronounced.

The suction zones are not only limited in a tangential direction by sealing strips, but rather also in an axial direction (transverse direction to the paper web). What are referred to as edge deckles provide said delimiting of the suction zone. Since different paper types are usually produced on a paper machine, the width of the paper web differs slightly, for example due to differing shrinkage characteristics for the various products. Therefore, for optimal operation of the suction roll, the edge deckles frequently also need to be adjusted.

For this adjustment, the suction zone should not be too narrow (compare to the paper web), in order to avoid "edge flipping," that is, a lifting off or folding over of the paper web. However, it should also not be wider than the paper web, in order to avoid false air, which increases the energy consumption considerably.

The conventional adjustment of edge deckles is carried out using a bar on the operator side (threaded rod, normally with dimensioning), which bar indicates the depth of the edge deckle. Because this indicator does not enable a direct comparison between the position of the paper web and the edge deckle, the adjustment depends on the experience of the personnel. In this case, the operator looks for a web flapping of the paper web for example, which indicates that the edge deckle is extending too far into the paper web, and that a vacuum is no longer present at the edge.

For edge deckles, optical solutions that are more modern are also known from document EP2707544 B1, which solutions enable the identification of the edge deckles on the paper web. For solutions of this type, an intervention in the roll and the installation of electrical components are required in order to generate the light source. In addition, a system of this type is not suitable for all paper/felt combinations. Some combinations are so "fat" that the light beam can no longer be recognized.

SUMMARY

Embodiments of the present invention is to improve the weaknesses of the prior art.

In particular, the embodiments enable a reliable and reproducible positioning of sealing strips and/or edge deckles in suction rolls.

Furthermore, embodiments simplify the optimal adjustment of the suction roll for the operating personnel.

These embodiments are entirely attained by a method according to claim 1 and an apparatus according to claim 4. Preferred embodiments are described in the dependent claims.

According to embodiments, a method for adjusting a suction roll, in particular for a machine for producing or processing a web of fibrous material, is proposed, wherein the method comprises:

- recording images and/or videos of the exterior of the roll and transmitting the recording to a computing unit
  - determining the actual values of the position of the sealing strips and/or edge deckles and/or other, non-visible components by the computing unit through image analysis of the image and/or video recording of the exterior of the roll and/or by acquiring values from an embedded sensor system
  - displaying the determined actual values by superimposing the position of the non-visible components on a display with the image and/or video recording With this direct optical display of internal components that are otherwise not visible from the outside, it is then very easily possible for the operating personnel to carry out the optimal adjustment of the roll.

In addition, when the method is carried out again after a modification, for example of the sealing strip position, the operating personnel immediately sees the result of the adjustments performed.

Even if it is clear to the person skilled in the art, it should be noted here for the sake of completeness that, within the scope of this application, a "method for adjusting a suction roll" is also to be understood as a type of method in which no modifications or adjustments are carried out following the display of the determined actual values by superimposing the position of the non-visible components on a display with the image and/or video recording, since the components are already correctly positioned, for example.

Advantageous embodiments are described in the dependent claims.

It can thus be advantageous if the method additionally comprises:

- Providing target values for the position of the sealing strips and/or edge deckles and/or other non-visible components.
- Comparing the actual values and target values by the computing unit.
- Displaying the target/actual comparison on the display It can be additionally provided that the method also comprises:

- determining recommendations for adjusting the suction roll from the target/actual comparison
- displaying the recommendations on the display.

With regard to the apparatus, embodiments are directed to an apparatus for adjusting a suction roll, in particular for a machine for producing or processing a web of fibrous material, comprising a camera for recording image/video recordings, a computing unit, and a display, wherein the camera is in contact with the computing unit such that it can transmit the image and/or video recordings to the computing unit. According to the invention, the apparatus is configured to perform a method according to an aspect of the invention.

The proposed method comprises aspects of what is referred to as augmented reality (AR).

In the reality-virtuality continuum (according to Paul Milgram, et al., 1994), augmented reality (AR) and augmented virtuality are part of what is referred to as mixed reality. While the term augmented virtuality is hardly used by experts, augmented reality and mixed reality, infrequently also enhanced reality, are usually used synonymously. In contrast to virtual reality, in which the user is completely immersed in a virtual world, the display of additional information has priority in augmented reality. For the visual modality, this results in significantly tougher requirements in terms of position determination (tracking) and calibration.

An AR system (ARS for short) is understood as meaning the system of technical component parts that are necessary in order to build an augmented reality application: camera, tracking devices, support software, etc.

The literature generally uses the definition of augmented reality provided by Azuma (http://www.cs.unc.edu/~azuma/ARpresence.pdf):

- Virtual reality and reality are combined with one another (partially superimposed).
- Interactivity in real time.
- Real and virtual objects are in a 3-dimensional relation to one another.

Source: Wikipedia (https://de.wikipedia.org/wiki/ErweiterteRealit%C3% A4t)

Currently, the adjustment of the suction box is a task that involves the experience of the papermaker. During this adjustment, it is possible to influence the paper's dry content by 1-2%. Because there is no system that registers a direct comparison between the position of the sealing strips and the separation of the covering, the papermaker must indirectly arrive at the correct adjustment on the basis of visual observations (for example, nip dewatering spray). With the invention, the papermaker will be capable of identifying the position of the sealing strips and will be able to directly compare it with the position of the covering. Ideally, the position of the sealing strip is thereby virtually projected onto the felt, that is, is displayed on the display of an app, for example.

In addition to the adjustment of the suction box, an embodiment of the invention can also locate the edge deckle of the suction box in relation to the paper web. It is thus possible to also carry out the adjustment of said component using the system, without needing to introduce an additional system in the roll. This is particularly advantageous for customers who are unable to take advantage of an optical system such as that in EP2707544 B1 since the light intensity is not sufficient.

In order to assist the operator with the adjustments in the best possible manner and to significantly facilitate the procedure, it is envisaged that the app can, in addition, also provide live data from the PLS/QCS, for example such as the moisture content of the paper web, moisture cross profile, press load, vacuum, etc. With the direct feedback of live data, it should, in combination with the app, be even easier for the operator to arrive at the correct adjustment.

The saving of adjustments can likewise be provided—for example, for specific operating states of the machine, or even for each roll. With this "position saving," the operator can make changes and easily finds the original position again without a problem. This is a significant added value for troubleshooting in particular.

The main focus of the solution is the identification of boundaries of the suction zones of the suction roll by a constructive intervention (AR projection), in order to optimally adjust them in the machine. A mobile computer (for example, mobile phone, tablet, AR goggles) can be used as an interface for the papermaker, which mobile computer uses image recognition to detect certain distinctive points or, where applicable, markings on the roll that serve as input for the application. The solution is divided into 2 functions.

The main focus is the virtual projection of the non-visible components of a suction roll onto the environment, in order to thus be able to determine the precise and direct position without needing to mentally estimate or extrapolate it (which is always imprecise):

1. "Suction box positioning"—Based on markings on the suction box, for example. The AR tool projects an identifier (e.g., colored lines) on the outer roll surface/covering/paper web so that it is possible to identify the region "A" (roll/covering separation) and the suction box can be adjusted. (The projection is thereby usually implemented as a virtual projection, that is, as a display of the projected element on the interface, in the form of the mobile phone display or the like)—As a support, a "traffic light system" can be implemented in the AR application so that the optimal adjustment can be determined using the application;
2. "Edge deckle positioning"—The AR application projects an identifier on the outer roll surface/covering/paper web, typically based on the indicator of the threaded rod of the edge deckle of the roll. With the aid of this tool, the papermaker can then intuitively adjust the edge deckles in relation to the paper web.

The virtual projection of non-visible components onto a suction roll can take place with the support of a compact computer (for example, smartphone, tablet, or AR goggles) that has access to a camera and screen. The detailed intermediate steps are listed below:

An embodiment according to one aspect of the invention can, for example, be the following method:

1. Recording images/videos of the roll using a computer or camera
   The recording of images/videos thereby takes place from the exterior of the roll
   The computer can, for example, be a smartphone, a tablet, or AR goggles;
2. Determining the position of the sealing strips, edge deckles, and/or other non-visible components (actual values)
3. This step can take place using (real-time) image recognition (for example, identification of marker(s) on the roll) and/or an embedded sensor system
4. Inputting reference values and/or target values for the roll
   Reference values for the determined parameters can be downloaded from a database (support using ID tagging improves the usability of the application) and/or populated by the user;
5. On the basis of actual values and target values, the position of the non-visible components is compared with an ideal state; this can occur either with a time delay or in real time.
6. With the aid of the determined actual values (step 2) and the reference values (step 3), the image/video recordings are superimposed with the position of the non-visible components. A display can be used for this purpose. This can occur either with a time delay or in real time
7. An indicator with a target/actual comparison (for example, with a traffic light system) can be displayed in order to assist the user with the adjustment of the suction box/edge deckle;
8. (Optional): The operator adjusts the roll (scaling strip or edge deckle); this can take place either in real time, with a simultaneous observation of the AR image and an approach toward the desired state, or else with a time delay in that the current situation is assessed and a change is then made, and the situation is then once again assessed.
9. (Optional): Steps 1-6 are repeated;
10. (Optional): Steps 1-8 are repeated until the target/actual comparison is satisfactory for the operator.

Particular advantages of the approaches to the solution:

A direct comparison between the covering and the position of the sealing strips is possible, which is new for the adjustment of the suction box;

No intervention in the suction box necessary, which increases the robustness of the solution and reduces costs for service; likewise, no systems that can fail are installed in the roll.

With the implementation of a "traffic light system" in the display of the AR application, a user with less experience could perform the adjustments alone.

Saving of positions helps the papermaker rapidly adjust ideal positions for different operating states or rolls Live data from the PLS or QCS assist the operator with adjustment, in order to arrive at the ideal adjustment The adjustment of the suction box and of the edge deckles should function in a significantly faster, simpler, and more reliable manner.

Other possible variants are described below. The different variants can thereby be used individually or in combination.

Variant 1:

Both functions of the application are viewed separately (adjusting the suction box and adjusting the edge deckle). The display is composed of projected colored lines which represent the position of the sealing strips and/or the edge deckle. The inputs for the application take place on the basis of image processing—detection of markings on the roll and the depth of the threaded rod of the edge deckle.

Variant 2:

In addition to image recognition as an input for the application, the device (for example, mobile phone, tablet, AR goggles) can be supported by a sensor system installed on the roll.

EXAMPLES

"Suction box positioning"

detection of the relative angle of the suction box to the mounting position, for example through the use of an encoder;

detection of the absolute angle of the suction box, for example through the use of an accelerometer;

"Edge deckle positioning"—detection of the position of the edge deckles by an integrated encoder on the threaded rod.

Variant 3:

The user will have the capability of viewing the projection of the sealing strips or edge deckles through the AR application, instead of displaying simple position lines alternative displays are also possible, for example such as the projection on the suction box of an area which represents the entire suction zone, together with the edge deckles and sealing strips that delimit the suction zone;

the projection of a CAD model of the suction box, in order to view all internal components and to enable a direct comparison.

BRIEF DESCRIPTION OF THE DRAWINGS

The invention is explained in greater detail below with the aid of schematic figures.

The invention is thereby not limited to these embodiments.

DETAILED DESCRIPTION

Figure 1:
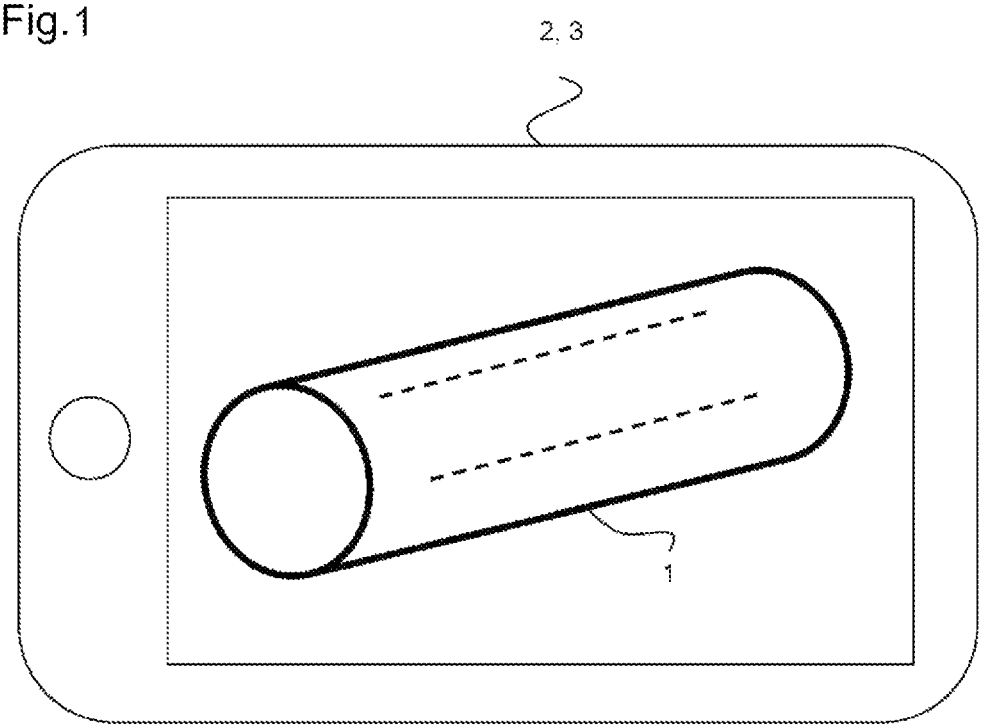
FIG. 1 shows a possible display of the determined actual values.

FIG. 1 shows a computing unit 2 having a display 3, such as that which is suitable for use in an embodiment of the present invention. An image or video recording of the suction roll 1 is thereby transmitted to the computing unit 2. The computing unit 2 can then, using image analysis of the image and/or video recording of the exterior of the roll and/or using the acquisition of values from an embedded sensor system, determine the position of non-visible inner installations such as sealing strips or edge deckles, for example. Thus, for example, the threaded rod for adjusting the edge deckles, which normally has dimensioning, can be identified and evaluated on the image, which allows the position of said edge deckles to be determined. In a similar manner, optical markings on the cover of the roll can be provided, from which markings the position of said sealing strips can be determined by image analysis.

Furthermore, it is possible for the computing unit to be connected to a further database from which information about the relevant suction roll is stored. An identification of the suction roll can take place via an ID tag, for example. It can be possible to either directly identify said ID tag optically from the image or video recording. Alternatively or additionally, however, a different tag, for example an RFID tag, can also be used. In that case, it is generally advantageous that said tag can also be directly read by the computing unit, for example a mobile phone or tablet computer.

In FIG. 1, it is, by way of example, outlined how, on the display 3 of the computing unit 2, the position of two sealing strips, in the form of dashed lines, is superimposed on the image or video recording of the suction roll 1.

Figure 2A:
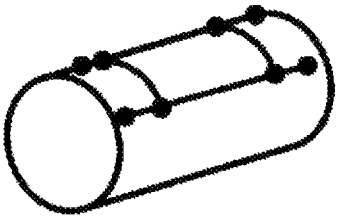
FIGS. 2*a*, 2*b*, 2*c* show alternative displays of the determined actual values.
Figure 2B:
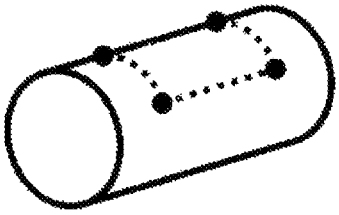
Figure 2C:
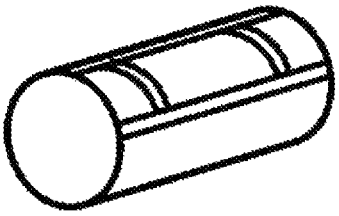

FIGS. 2*a*, 2*b*, and 2*c* show alternative illustrations of the installations on the image of the suction roll. For example, sealing strips and edge deckles can be displayed at the same time, as in FIG. 2*a*. FIG. 2*b* shows, by way of example, the suctioned area, which is formed by sealing strips and edge deckles.

FIG. 2*c* is intended to indicate that even more information can also be displayed on the display 3. There, it is data from the CAD system which superimpose the relevant details of the inner structure of the suction roll on the image of the roll. In principle, it is possible in this case to display, at specific locations, a plurality of information that makes the adjustment easier for the operating personnel.

The invention claimed is:

1. A method for adjusting a suction roll, in which the suction roll includes a marker for a position of sealing strips, the method comprising:

recording images and/or videos of an exterior of the suction roll, including the marker, and transmitting the recording to a computing unit;

performing image analysis on the recorded images and/or videos of the exterior of the suction roll to determine, in the computing unit, actual values of the position of the sealing strips within the suction roll and/or a position of edge deckles within the suction roll and/or a position of other, non-visible components within the suction roll;

superimposing over a display of the recorded images and/or videos of the exterior of the suction roll images of the determined actual values of the position of the sealing strips within the suction roll and/or the position of the edge deckles within the suction roll and/or the position of the other, non-visible components within the suction roll; and using the superimposed images of the determined actual values of the position of the sealing strips within the suction roll and/or the position of the edge deckles within the suction roll and/or the position of the other, non-visible components within the suction roll over the display of the recorded images and/or videos of the exterior of the suction roll and the marker as a reference for adjusting the position of at least one of the sealing strips and/or the edge deckles and/or the other, non-visible components within the suction roll.

2. The method according to claim 1, wherein the method additionally comprises:

providing target values for the position of the sealing strips and/or edge deckles and/or other non-visible components;

comparing the actual values and target values by the computing unit; and displaying results of the target/actual comparison on the display.

3. The method according to claim 2, wherein the method additionally comprises:

determining recommendations for adjusting the suction roll from the target/actual comparison; and displaying the recommendations on the display.

4. The method according to claim 1, wherein the suction roll is arranged in a machine for producing or processing a web of fibrous material.

5. An apparatus for adjusting a suction roll, in which the suction roll includes a marker for a position of sealing strips comprising:

a camera for recording images and/or video recordings of an exterior of the suction roll and the marker;

a computing unit; and a display, wherein the camera is coupled to the computing unit to transmit the image and/or video recordings of the exterior of the suction roll to the computing unit, and wherein the computing unit is configured to:

perform image analysis of the recorded images and/or videos of the exterior of the suction roll and the marker from the camera to determine actual values of the position of the sealing strips within the suction roll and/or a position of edge deckles within the suction roll and/or a position of other, non-visible components within the suction roll, and superimpose over a display of the recorded images and/or videos of the exterior of the suction roll the determined actual values of the position of the sealing strips within the suction roll and/or the position of the edge deckles within the suction roll and/or the position of the other, non-visible components within the suction roll, and wherein the superimposed images of the determined actual values of the position of the sealing strips within the suction roll and/or the position of the edge deckles within the suction roll and/or the position of the other, non-visible components within the suction roll over the display of the recorded images and/or videos of the exterior of the suction roll and marker from the camera are usable as a reference for adjusting the position of the sealing strips within the suction roll and/or the position of the edge deckles within the suction roll and/or the position of the other, non-visible components within the suction roll to an optimal position for operation.

6. The apparatus according to claim 5, wherein the suction roll is configured for operation in a machine for producing or processing a web of fibrous material.

* * * * *